United States Patent [19]

O'Brien

[11] 4,081,918

[45] Apr. 4, 1978

[54] GOLF TRAINING DEVICE

[76] Inventor: John P. O'Brien, 175 E. Delaware Pl., Chicago, Ill. 60611

[21] Appl. No.: 735,761

[22] Filed: Oct. 26, 1976

[51] Int. Cl.[2] ..... A63B 69/36; A43C 15/00

[52] U.S. Cl. ..... 36/132; 36/127; 273/32 C; 273/187 B

[58] Field of Search ..... 273/32 C, 187 B, 188 A; 36/65, 127, 62, 64, 132, 133

[56] References Cited

U.S. PATENT DOCUMENTS

| | | | |
|---|---|---|---|
| 1,031,426 | 7/1912 | Czel | 36/65 |
| 2,482,930 | 9/1949 | Norwood | 36/65 X |
| 3,951,407 | 4/1976 | Calacurcio | 273/32 C |

*Primary Examiner*—George J. Marlo

*Attorney, Agent, or Firm*—Cook, Wetzel & Egan, Ltd.

[57] ABSTRACT

A wedge - shaped device for golfers includes an inwardly inclined surface against which the golfer in effect pushes with his rear foot during the execution of a club swing. At the lower and upper edges of the inclined surface upward extensions are provided, between which the golfer's rearwardly positioned shoe is located. A screw threaded plunger element is provided in the upper extension to compress the lower portion of the shoe between the upper and lower extensions, and thus clamp the device to the golfer's shoe.

5 Claims, 5 Drawing Figures

GOLF TRAINING DEVICE

The present invention relates to a golf training device, and more particularly to a wedge-shaped golf training device which may be removeably affixed to the sole of an ordinary shoe, thus enabling a golfer to practice his golf swing using the training device, but to readily remove the training device from the shoe for ordinary use. The golf training device of the present invention may also be used with regular golf shoes, or with conventional street shoes or sport shoes, without modification.

It is well known that many individuals could play an improved game of golf if they could develop a proper and consistent golf swing. Various books and articles on golf have been written wherein the proper form and style of golf swing is described. However, simply reading a book or article on how to swing the golf club and hit a golf ball does not inherently provide a golfer with the feel of a proper and consistent swing, nor does it provide him with a proper and consistent swing.

One of the major shortcomings in the swing of many golfers, and particularly among the high handicap golfers, is a tendency to sway "off the ball", i.e., away from the intended target, during the backswing, coupled with a failure to sway back to the point at which the swing was started, during the downswing. This fundamental error causes the golfer to have most of his weight on his rear foot and to swing from his rear foot, when the club head is brought back to the ball, which, in turn, frequently results in a slice, a topped shot, a smothered duckhook or other types of mishit golf shots which will be known to those having the ordinary skill in the art.

It has been recognized by golfers, and particularly golf teachers or golf teaching professionals that the tendency to sway "off the ball", away from the intended target, can be reduced if a golfer's rearward foot (the foot furthest from the intended target) is canted or tilted toward the target which causes the weight placed on this foot to move to the inside edge of the foot. The canting of the rear foot toward the target also tends to keep the golfer's weight equally distributed between the rear foot and the front foot and serves as a reminder to the golfer to avoid swaying "off the ball" during the backswing.

It is theorized that canting the rear foot toward the target will allow a golfer to transfer as much as 60 or 70% of his weight to the inside edge of his rear foot, but at the same time a substantial portion of the golfer's weight will remain on the front foot throughout the entire swing including the top of the backswing. Canting the rear foot toward the target will tend to force the golfer to keep his weight on the inside edge of his foot and thus reduce the chances that the golfer will transfer all of his weight to the rear foot. When the golfer's weight is thus distributed at the top of his backswing, i.e., no more than about 70% of his weight on the rear foot, he is able to shift his weight to the front foot during the downswing, at the same time maintain a steady head position "over the ball".

Many devices have been devised by the prior art in order to accomplish the canting of the rear foot toward the target. Some golf teaching professionals simply suggest that their pupils place a golf ball under the outside edge of the rear foot. While such an expedient can be used, every time the golfer wishes to reposition his rear foot, it is necessary to reposition the golf ball under his shoe.

The prior art has suggested the use of golf shoes wherein one or both of the shoes are canted inwardly. In particular, U.S. Pat. No. 3,789,523 suggests that the rear foot be equipped with a shoe which is canted toward the target. However, this patent describes a shoe which is permanently raised along its outer edge. While this might achieve some of the objectives of the present invention, insofar as giving the golfer the feel of the correct golf swing, such shoes are not adapted to be used as an ordinary street shoe or as ordinary golf shoes. Further, walking substantial distances with one shoe canted would probably be uncomfortable and might cause various orthopedic problems.

Applicant's U.S. Pat. No. 3,218,734 describes a removable supporting attachment for golf shoes, wherein the removable support is adapted to be affixed to a specifically designed spike or cleat in a golf shoe, which is inserted in the golf shoe for the purpose of holding the support attachment. While this device was successful in giving a golfer the correct feel of a proper swing, and had the advantage of being removable, the means for attaching the supporting device required the use of a special spike or cleat which had certain inherent limitations. As a practical matter, the device of U.S. Pat. No. 3,218,734 was not readily usable with ordinary street shoes or sport shoes other than golf shoes.

Applicant's copending application Ser. No. 661,779 filed Feb. 24, 1976, describes a golf training device adapted to be removably affixed to a golf shoe, wherein an annular magnet holds the training device to the flange of a standard golf spike which is mounted on a golf shoe. While the device described and claimed in the copending application has many desirable attributes, it is not adapted to be used on shoes other than golf shoes which are fitted with conventional spikes.

Applicant's copending parent appliction Ser. No. 683,898, filed May 6, 1976, provides a wedge-shaped golf training device adapted to be removably affixed to a shoe which need not be a golf shoe, but which is modified suitably to receive the wedge-shaped golf training device. In particular, the wedge-shaped golf training device is fitted with a plurality of sole-engaging pins, adopted to mate with a complementary series of holes in the sole of the shoe, under the arch, horizontal and parallel to the ordinarily plane of the shoe. Since a great deal of golf practice is conducted at driving ranges which are open to the public, it is important to provide a training device which may be used with ordinary shoes. Many of the customers at such driving ranges are not equipped with golf shoes, but are wearing street shoes or sports shoes of various configurations not equipped with golf spikes. The golf training device of the parent application, Ser. No. 683,898, discloses and claims a wedge-shaped golf training device which could be affixed to conventional shoes which were produced or suitably modified to mate with golf training device.

The present invention is an improvement in that it provides a golf training device, a similar wedge-shaped configuration, which can be affixed to an ordinary pair of shoes without any modification to the shoe. Further, the golf training device of the present invention can be used with golf shoes, as well as street shoes, or sport shoes of any configuration and can be so employed without any modification to the shoes.

The advantages of the present invention will become apparent from the following specification and claims and from the accompanying drawings in which:

Figure 1:
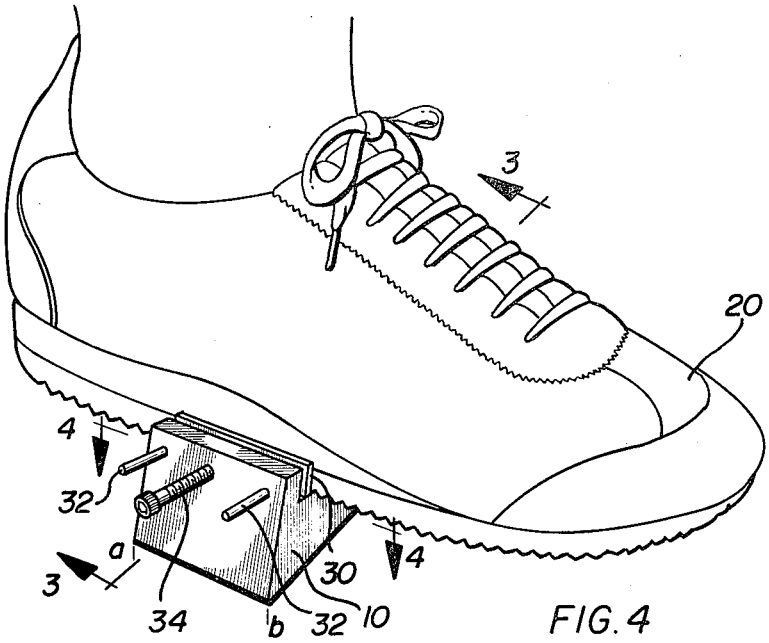
FIG. 1 is an isometric view of the wedge-shaped golf training device of the present invention affixed to a sport shoe for the right foot, as it would be used in practice.

The wedge-shaped golf training device of the present invention, as it would be used by righthanded golfers, is shown affixed to the shoe for the right foot in FIG. 1. The training device as shown is placed on the outside edge of the right foot, thus inwardly canting the right foot of the righthanded golfer toward the target which lies ahead and the golfer's left side. When in place, as is shown in FIG. 1, the training device tends to cause the golfer to weight the inside edge of his right foot. Thus when the training device is in place, any weight shifted to the right foot will tend to remain on the inside of the foot, thus minimizing the chances that the golfer will sway to the rear, "off the ball", and away from the target during the backswing.

The preferred embodiment of the golf training device of the present invention which is shown in FIGS. 1-4, inclusive, includes a wedge-shaped body 10 which serves as the main supporting member for the shoe to be canted, shown generally at 20. The wedge-shaped body includes an upper surface 11 adapted to support the sole 21 of shoe 20. The wedge-shaped body 10 also includes a lower, ground-engaging surface 12, more clearly shown in FIG. 3, which defines an acute angle with respect to upper surface 11. While the angle between upper surface 11 and ground-engaging surface 12 is not critical, it is generally preferred to have an angle of about 30°. The lower, ground-engaging surface 12 is preferably planar, although it may be knurled or otherwise fashioned to produce an increased frictional engagement with the ground, thus reducing the possibility of slippage in use. The lower end of wedge-shaped body 10 is desirably truncated in order to reduce the overall length and facilitate storage when not in use.

Figure 3:
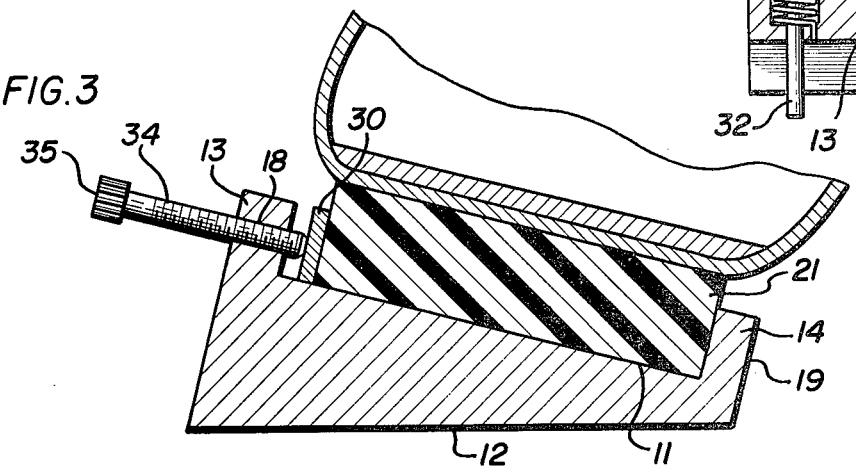
FIG. 3 is a sectional side view showing the preferred embodiment of the wedge-shaped golf training device in place on a shoe, taken in section 3—3 of FIG. 1.

Wedge-shaped body 10 includes upper extension 13 and lower extension 14, which extend from upper surface 11 at approximately right angles to upper surface 11. Lower extension 14 is adapted to abutt the side of sole 21, as is shown in FIG. 3.

Upper extension 13 is adapted to cooperate with plunger 30 and permit plunger alignment pins 32 to pass through openings 16 in upper extension 13 and parallel to upper surface 11. In the embodiment shown in FIGS. 1 through 4, threaded member 34 threadebly engages central opening 18 in upper extension 13 and bears against plunger 30 near its center point 31. Preferably, threaded member 34 includes a knurled knob 35 adapted to rotate and move threaded member 34 toward sole 21 or away from sole 21, parallel to said upper surface 11, thereby regulating the position of plunger 30 with respect to sole 21. In order to attach the wedge-shaped golf training device of the present invention to a shoe, the threaded member and plunger are opened sufficiently to accommodate the sole of the shoe, the sole member 21 is placed against sole engaging upper surface 11, between upper extension 13 and lower extension 14, and the threaded member 34 is screwed inwardly until the plunger bears against the sole 21, compressing sole 21 between lower extension 14 and plunger member 30. Sufficient compressive force is applied to the sole through turning threaded member 34, so that the wedge-shaped golf training device is frictionally held in position enabling the user to walk about with the golf training device affixed to the shoe.

While it is generally preferred that upper support surface 11 be essentially planar, the present invention also contemplates the use of non-planar surfaces. For example, the surface 11 may be formed into an irregular surface or into a surface which complements the lower surface of the shoe sole.

Figure 2:
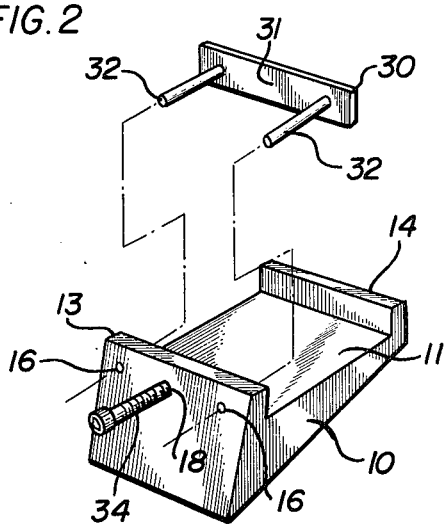
FIG. 2 is an isometric view of the wedge-shaped golf training device of the present invention removed from the shoe and wherein the clamping member has been removed and separated from the wedge body.
Figure 4:
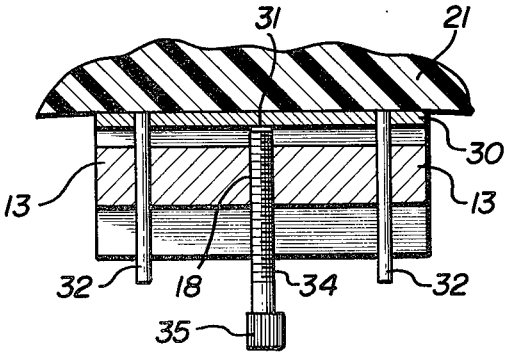
FIG. 4 is a partial, sectional top view of the preferred embodiment of the wedge-shaped golf training device in place on the shoe, taken in section 4—4 of FIG. 1.

If desired, pins 32 may be peened, mushroomed, or equipped with stopping members which prevent pins 32 from sliding inwardly all the way out of opening 16, when the training device is not in use, thereby permitting the plunger assembly 32 to be disengaged as shown in FIG. 2. Alternatively, the threaded member 34 may be permanently, but notatably affixed to plunger 30 at center point 31 in order to keep the plunger from being removed from the wedge-shaped member 10.

Figure 5:
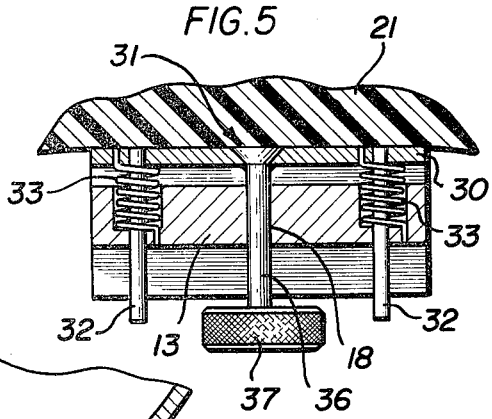
FIG. 5 is a partial, section top view of another embodiment of the wedge-shaped golf training device in place on the shoe, taken in section 4—4 of FIG. 1.

Another embodiment of the golf training device is shown in FIG. 5. In this embodiment the plunger 30 and plunger pins 32 are similar to those shown in the preferred embodiment, but a pair of springs 33 surround the plunger pins 32. Said springs 33 are held under compression and thereby urge the plunger 30 away from upper extension 13. In this embodiment, pin 36 is not threaded and is adapted to slide through opening 18, which also need not be threaded. One end of pin 36 is secured to plunger 30 at center point 31, and the other end of pin 36 is equipped with a knob on the other side of upper extension 14, which knob is preferably knurled. In order to provide the embodiment shown in FIG. 5, knob 37 is pulled outwardly, whereby the plunger is moved outwardly and springs 33 are compressed. The sole 21 of the shoe 20 is thereafter positioned, as is shown in FIG. 3, and the knob is released, allowing springs 33 to urge plunger 30 against sole 21, thus holding sole 21 under compression, and holding the wedge-shaped training device in position on the shoe.

The present invention also contemplates that lower extension 14 and plunger 30 may have their inner surfaces which are adapted to promote the frictional engagement of the sole 21. In other words, the surfaces of plunger 30 and the inward surface of lower extension 14 may be knurled or coated with abrasive materials in order to improve the connection of the training device to the soles. Further, the present invention contemplates that plunger 30 and lower extension 14 may have inwardly directed flanges at their upper edges, for the purpose of improving the grip of the wedge-shaped training device to the sole of the shoes.

As was mentioned above, the angle at which upper surface 11 exists will respect to the lower, ground-engaging surface 12, may be varied over wide limits. It is essential that the distance between upper extension 13 and lower extension 14 be adequate to accommodate the width of the sole of any shoes on which the device is to be used. It has been found that an opening of about 3½ inches is adequate to accommodate most shoes. The height to which upper extension 13 and lower extension 14 extend, as measured from shoe-engaging surface 11, can be varied over wide limits. Generally, extensions of about ½ inch are adequate to engage the sole of most conventional type shoes. The width of the wedge-shaped member may also be varied over wide limits. It has been found that a width of from 1 to 2 inches (as measured from point *a* to point *b* in FIG. 1) is preferred, although greater or lesser widths may be employed.

While it is preferred to install the golf training device under the arch portion of the shoe, as is shown in FIG. 1, the training device may be used on any portion of the shoe. If it is to be employed on the widest portion of the shoe, i.e., under the ball of the foot, it is preferable to produce a somewhat wider wedge, i.e., the width of the upper surface 11 should be as much as 4½ inches, as measured between upper extension 13 and lower extension 14.

The wedge-shaped device of the present invention may be constructed of any desired material of construction including metal, plastic, wood or combinations thereof. It will be understood by those skilled in the art that other equivalent attaching devices may be used, so long as they are adapted to hold the shoe sole under compression, whereby the training device is removable, but frictionally held to the shoe in the desired position. The forms of invention herein shown and described are to be considered only as illustrative. It will be apparent to those skilled in the art that numerous modifications may be made therein without departure from the spirit of the invention or the scope of the appended claims.

I claim:

1. A wedge-shaped golf training device adapted to be removably affixed to a shoe, said training device comprising a wedge-shaped body having a lower, ground engaging surface, and an upper support surface, said upper support surface adapted to support the lower surface of a shoe, said wedge-shaped body including an upper extension and a lower extension extending at right angles to said upper support surface, said upper extension including plunger means adapted to move parallel to said upper support surface, and means to adjustably urge said plunger means toward said lower extension and frictionally engage the sole of a shoe between said plunger means and said lower extension.

2. A wedge-shaped golf training device as described in claim 1, wherein said upper support surface is essentially planar.

3. A wedge-shaped golf training device as described in claim 1, wherein said wedge-shaped body in truncated.

4. A wedge-shaped training device as described in claim 1, wherein said plunger means includes a threaded member threadedly engaged through said upper extension, which threaded member is adapted to adjust the position of said plunger means relative to said lower extension and thereby maintain and adjust a compressive force on said shoe sole.

5. A wedge-shaped device as described in claim 1, wherein the means to urge said plunger means toward said lower extension comprises a spring.

* * * * *